US009536482B2

(12) United States Patent
Yang et al.

(10) Patent No.: US 9,536,482 B2
(45) **Date of Patent: *Jan. 3, 2017**

(54) DISPLAY DEVICE AND DRIVING MODULE THEREOF

(71) Applicant: NOVATEK Microelectronics Corp., Hsin-Chu (TW)

(72) Inventors: Kai-Min Yang, Kaohsiung (TW); Feng-Ting Pai, Hsinchu (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 57 days.

This patent is subject to a terminal disclaimer.

(21) Appl. No.: 14/730,247

(22) Filed: Jun. 4, 2015

(65) Prior Publication Data

US 2016/0155397 A1 Jun. 2, 2016

(30) Foreign Application Priority Data

Dec. 2, 2014 (TW) ..... 103141861 A

(51) Int. Cl.
*G09G 3/36* (2006.01)

(52) U.S. Cl.
CPC .... *G09G 3/3607* (2013.01); *G09G 2300/0426* (2013.01); *G09G 2300/0452* (2013.01); *G09G 2300/0465* (2013.01); *G09G 2330/021* (2013.01)

(58) Field of Classification Search
CPC ..... G09G 2300/0452; G09G 3/2003; G09G 3/3607; G09G 5/02; G09G 2300/0443; G09G 3/3208; G09G 3/3233
See application file for complete search history.

(56) References Cited

U.S. PATENT DOCUMENTS 5,642,176 A 6/1997 Abukawa
6,750,875 B1 6/2004 Keely, Jr.
(Continued)

FOREIGN PATENT DOCUMENTS

CN 1941060 A 4/2007
TW 200849167 12/2008
(Continued)

OTHER PUBLICATIONS

Kai-Min Yang et al., Title: Display Device and Driving Module thereof, pending U.S. Appl. No. 14/730,245, filing date: Jun. 4, 2015.

(Continued)

*Primary Examiner* — Duc Dinh
(74) *Attorney, Agent, or Firm* — Winston Hsu; Scott Margo

(57) ABSTRACT

A display device with a plurality of sub-pixel groups is disclosed. Each of the sub-pixel groups comprises a first sub-pixel, located at a first column; a second sub-pixel, located at a second column adjacent to the first column; a third sub-pixel, located at a third column adjacent to the second column; a fourth sub-pixel, located at a fourth column adjacent to the third column; and a fifth sub-pixel, located at the fourth column; wherein the row of the second sub-pixel overlaps the row of the first sub-pixel; wherein the row of the third sub-pixel overlaps the row of the first sub-pixel; wherein the row of at least one of the fourth sub-pixel and the fifth sub-pixel overlaps the row of the first sub-pixel; wherein a sum of the heights of the fourth sub-pixel and the fifth sub-pixel is smaller than or equal to the height of the first sub-pixel.

17 Claims, 13 Drawing Sheets

(56) References Cited

U.S. PATENT DOCUMENTS

| | | | | |
|---|---|---|---|---|
| 6,867,549 | B2 | 3/2005 | Cok | |
| 6,903,754 | B2 | 6/2005 | Brown Elliott | |
| 8,552,635 | B2 * | 10/2013 | Kim | G09G 3/2003 313/504 |
| 2004/0085495 | A1 | 5/2004 | Roh | |
| 2005/0068477 | A1 | 3/2005 | Shin | |
| 2009/0121983 | A1 | 5/2009 | Sung | |
| 2014/0204008 | A1 * | 7/2014 | Chu-Ke | G09G 3/2003 345/88 |
| 2015/0061978 | A1 | 3/2015 | Shih | |
| 2015/0380471 | A1 | 12/2015 | Guo | |

FOREIGN PATENT DOCUMENTS

| | | |
|---|---|---|
| TW | 201033682 | 9/2010 |
| TW | 201035655 | 10/2010 |
| TW | 201145242 | 12/2011 |
| TW | 201227704 | 7/2012 |

OTHER PUBLICATIONS

Kai-Min Yang et al., Title: Display Device and Driving Module thereof, pending U.S. Appl. No. 14/813,109 , filing date: Jul. 29, 2015.

* cited by examiner

DISPLAY DEVICE AND DRIVING MODULE THEREOF

BACKGROUND OF THE INVENTION

1. Field of the Invention

The present invention relates to a display device and driving module thereof, and more particularly, to a display device reducing power consumption and increasing brightness via changing sub-pixel arrangement and driving module thereof.

2. Description of the Prior Art

A liquid crystal display (LCD) is a flat panel display which has the advantages of low radiation, light weight and low power consumption and is widely used in various information technology (IT) products, such as notebook computers, personal digital assistants (PDA), and mobile phones. An active matrix thin film transistor (TFT) LCD is the most commonly used transistor type in LCD families, and particularly in the large-size LCD family. A driving system installed in the LCD includes a timing controller, source drivers and gate drivers. The source and gate drivers respectively control data lines and scan lines, which intersect to form a cell matrix. Each intersection is a cell including crystal display molecules and a TFT. In the driving system, the gate drivers are responsible for transmitting scan signals to gates of the TFTs to turn on the TFTs on the panel. The source drivers are responsible for converting digital image data, sent by the timing controller, into analog voltage signals and outputting the voltage signals to sources of the TFTs. When a TFT receives the voltage signals, a corresponding liquid crystal molecule has a terminal whose voltage changes to equalize the drain voltage of the TFT, which thereby changes its own twist angle. The rate that light penetrates the liquid crystal molecule is changed accordingly, allowing different colors to be displayed on the panel.

An image quality of the LCD can be determined via counting a number of pixels of the LCD located in a direction. For example, the user may acquire a reference of determining the image quality of the LCD via calculating the pixels per inch (PPI). Please refer to FIG. 1, which is a schematic diagram of the relationship between the image quality and the PPI. As shown in FIG. 1, the image quality is proportional to the PPI. However, recognizing ability of the eyes has a limit. When the PPI of the LCD exceeds a threshold, the eyes generally cannot recognize each pixel of the LCD. In other words, the image viewed by the eyes would become no-grid if the PPI of the LCD exceeds the threshold.

For example, under a condition that the visual acuity of the eyes is 1.0 and a distance between the eyes and the LCD is 12 inches, it is difficult for the eyes to recognize distances between the pixels of the LCD when the PPI of the LCD exceeds 286. In other words, the image received by the eyes becomes no-grid if the PPI of the LCD reaches 286. In such a condition, the number of sub-pixels corresponding to each pixel can be accordingly decreased, to increase the aperture ratio and to reduce the power consumption of the LCD. Thus, how to decrease the number of sub-pixel while maintaining the image quality becomes a topic to be discussed.

SUMMARY OF THE INVENTION

In order to solve the above problem, the present invention provides a reducing power consumption and increasing brightness via changing sub-pixel arrangement and driving module thereof.

In an aspect, a display device with a plurality of sub-pixel groups is disclosed. Each of the sub-pixel groups comprises a first sub-pixel, a second sub-pixel, a third sub-pixel, a fourth sub-pixel, and a fifth sub-pixel. The first sub-pixel is located at a first column, the second sub-pixel is located at a second column adjacent to the first column, the third sub-pixel is located at a third column adjacent to the second column, the fourth sub-pixel is located at a fourth column adjacent to the third column, and the fifth sub-pixel is located at the fourth column. The row of the second sub-pixel overlaps the row of the first sub-pixel; the row of the third sub-pixel overlaps the row of the first sub-pixel; the row of at least one of the fourth sub-pixel and the fifth sub-pixel overlaps the row of the first sub-pixel; a sum of the heights of the fourth sub-pixel and the fifth sub-pixel is smaller than or equal to the height of the first sub-pixel.

In another aspect, a driving module for a display device with a plurality of sub-pixel groups is disclosed. Each of the sub-pixel groups comprises a first sub-pixel, a second sub-pixel, a third sub-pixel, a fourth sub-pixel, and a fifth sub-pixel. The first sub-pixel is located at a first column, the second sub-pixel is located at a second column adjacent to the first column, the third sub-pixel is located at a third column adjacent to the second column, the fourth sub-pixel is located at a fourth column adjacent to the third column, and the fifth sub-pixel is located at the fourth column. The row of the second sub-pixel overlaps the row of the first sub-pixel; the row of the third sub-pixel overlaps the row of the first sub-pixel; the row of at least one of the fourth sub-pixel and the fifth sub-pixel overlaps the row of the first sub-pixel; a sum of the heights of the fourth sub-pixel and the fifth sub-pixel is smaller than or equal to the height of the first sub-pixel.

In another aspect, a display device with a plurality of sub-pixel groups is disclosed. Each of the sub-pixel groups comprises a first sub-pixel, a second sub-pixel, a third sub-pixel, a fourth sub-pixel, a fifth sub-pixel, a sixth-sub-pixel, a seventh-sub-pixel, an eighth sub-pixel, a ninth sub-pixel, a tenth sub-pixel, a eleventh sub-pixel, a twelfth sub-pixel, a thirteen sub-pixel, a fourteenth sub-pixel, a fifteenth sub-pixel, a sixteenth sub-pixel, a seventeen sub-pixel, an eighteenth sub-pixel, a nineteenth sub-pixel, a twentieth sub-pixel, a twenty-first sub-pixel, and a twenty-second sub-pixel. The first sub-pixel is located at a first column; the second sub-pixel is located at the first column; the third sub-pixel is located at a second column adjacent to the first column; the fourth sub-pixel is located at a third column adjacent to the second column; the fifth sub-pixel is located at the fourth column adjacent to the third column; the sixth sub-pixel is located at the fourth column; the seventh sub-pixel is located at a fifth column adjacent to the fourth column; the eighth sub-pixel is located at a sixth column adjacent to the fifth column; the ninth sub-pixel is located at the sixth column; the tenth sub-pixel is located at a seventh column adjacent to the sixth column; the eleventh sub-pixel is located at an eighth column adjacent to the seventh column; the twelfth sub-pixel is located at the first column; the thirteenth sub-pixel is located at the second column; the fourteenth sub-pixel is located at the second column; the fifteenth sub-pixel is located at the third column; the sixteenth sub-pixel is located at the fourth column; the seventeenth sub-pixel is located at the fifth column; the eighteenth sub-pixel is located at the fifth column; the nineteenth sub-pixel is located at the sixth column; the twentieth sub-pixel is located at the seventh column; the twenty-first sub-pixel is located at the eighth column; and the twenty-second sub-pixel is located at the eighth column. The rows of the first sub-pixels, the second sub-pixel, the third sub-pixel, the fourth sub-pixel, the fifth sub-pixel, the sixth sub-pixel, the seventh sub-pixel, the eighth sub-pixel, the ninth sub-pixel, the tenth sub-pixel and the eleventh sub-pixel overlap to each other; the rows of the twelfth sub-pixels, the thirteenth sub-pixel, the fourteenth sub-pixel, the fifteenth sub-pixel, the sixteenth sub-pixel, the seventeenth sub-pixel, the eighteenth sub-pixel, the nineteenth sub-pixel, the twentieth sub-pixel, the twenty-first sub-pixel and the twenty-second sub-pixel overlap to each other; the first sub-pixel and the second sub-pixel are located at adjacent rows and the second and the twelfth sub-pixel are located at adjacent rows.

In another aspect, a driving module for a display device with a plurality of sub-pixel groups is disclosed Each of the sub-pixel groups comprises a first sub-pixel, a second sub-pixel, a third sub-pixel, a fourth sub-pixel, a fifth sub-pixel, a sixth-sub-pixel, a seventh-sub-pixel, an eighth sub-pixel, a ninth sub-pixel, a tenth sub-pixel, a eleventh sub-pixel, a twelfth sub-pixel, a thirteen sub-pixel, a fourteenth sub-pixel, a fifteenth sub-pixel, a sixteenth sub-pixel, a seventeen sub-pixel, an eighteenth sub-pixel, a nineteenth sub-pixel, a twentieth sub-pixel, a twenty-first sub-pixel, and a twenty-second sub-pixel. The first sub-pixel is located at a first column; the second sub-pixel is located at the first column; the third sub-pixel is located at a second column adjacent to the first column; the fourth sub-pixel is located at a third column adjacent to the second column; the fifth sub-pixel is located at the fourth column adjacent to the third column; the sixth sub-pixel is located at the fourth column; the seventh sub-pixel is located at a fifth column adjacent to the fourth column; the eighth sub-pixel is located at a sixth column adjacent to the fifth column; the ninth sub-pixel is located at the sixth column; the tenth sub-pixel is located at a seventh column adjacent to the sixth column; the eleventh sub-pixel is located at an eighth column adjacent to the seventh column; the twelfth sub-pixel is located at the first column; the thirteenth sub-pixel is located at the second column; the fourteenth sub-pixel is located at the second column; the fifteenth sub-pixel is located at the third column; the sixteenth sub-pixel is located at the fourth column; the seventeenth sub-pixel is located at the fifth column; the eighteenth sub-pixel is located at the fifth column; the nineteenth sub-pixel is located at the sixth column; the twentieth sub-pixel is located at the seventh column; the twenty-first sub-pixel is located at the eighth column; and the twenty-second sub-pixel is located at the eighth column. The rows of the first sub-pixels, the second sub-pixel, the third sub-pixel, the fourth sub-pixel, the fifth sub-pixel, the sixth sub-pixel, the seventh sub-pixel, the eighth sub-pixel, the ninth sub-pixel, the tenth sub-pixel and the eleventh sub-pixel overlap to each other; the rows of the twelfth sub-pixels, the thirteenth sub-pixel, the fourteenth sub-pixel, the fifteenth sub-pixel, the sixteenth sub-pixel, the seventeenth sub-pixel, the eighteenth sub-pixel, the nineteenth sub-pixel, the twentieth sub-pixel, the twenty-first sub-pixel and the twenty-second sub-pixel overlap to each other; the first sub-pixel and the second sub-pixel are located at adjacent rows and the second and the twelfth sub-pixel are located at adjacent rows.

These and other objectives of the present invention will no doubt become obvious to those of ordinary skill in the art after reading the following detailed description of the preferred embodiment that is illustrated in the various figures and drawings.

DETAILED DESCRIPTION

The present invention reduces a number of sub-pixels corresponding to each pixel via different arrangements of the sub-pixels. An aperture ratio and brightness of the liquid crystal display (LCD) are accordingly improved. The power consumption and the layout area of the LCD are further decreased.

Figure 1:
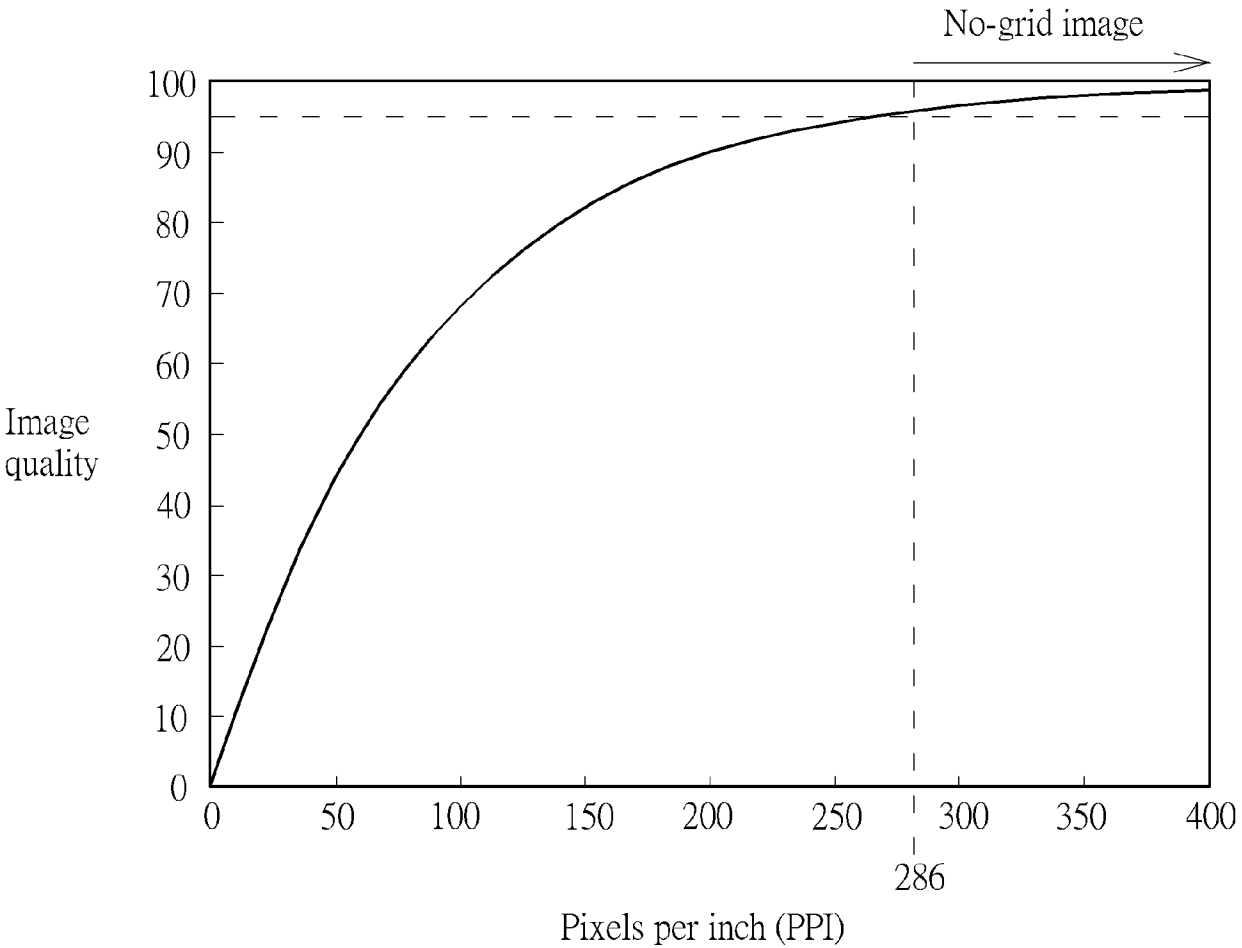
FIG. 1 PRIOR ART
FIG. 1 is a schematic diagram of the relationship between the image quality and the pixel per inch.
Figure 2:
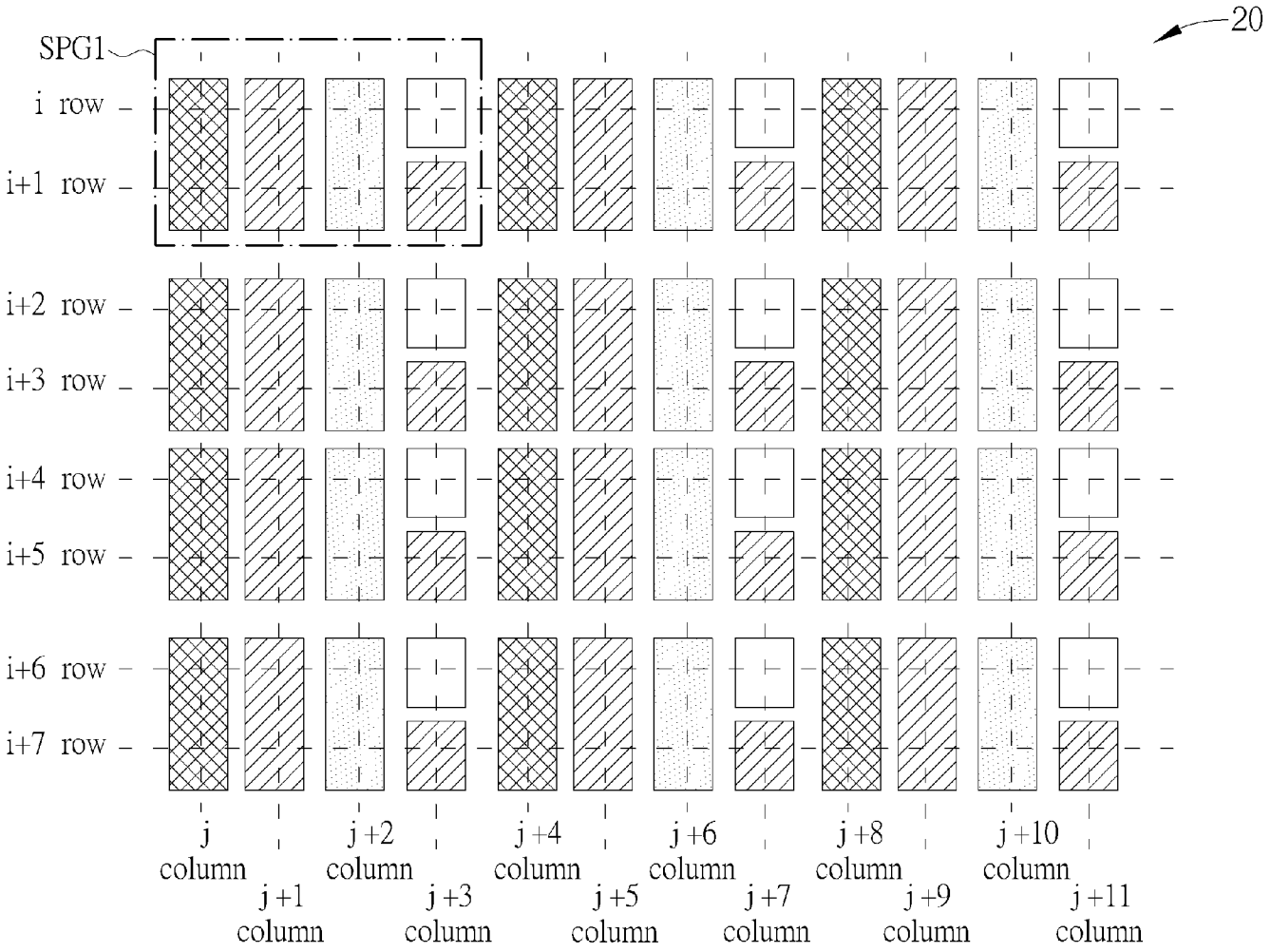
FIG. 2 is a schematic diagram of a display device according to an embodiment of the present invention.
Figure 3:
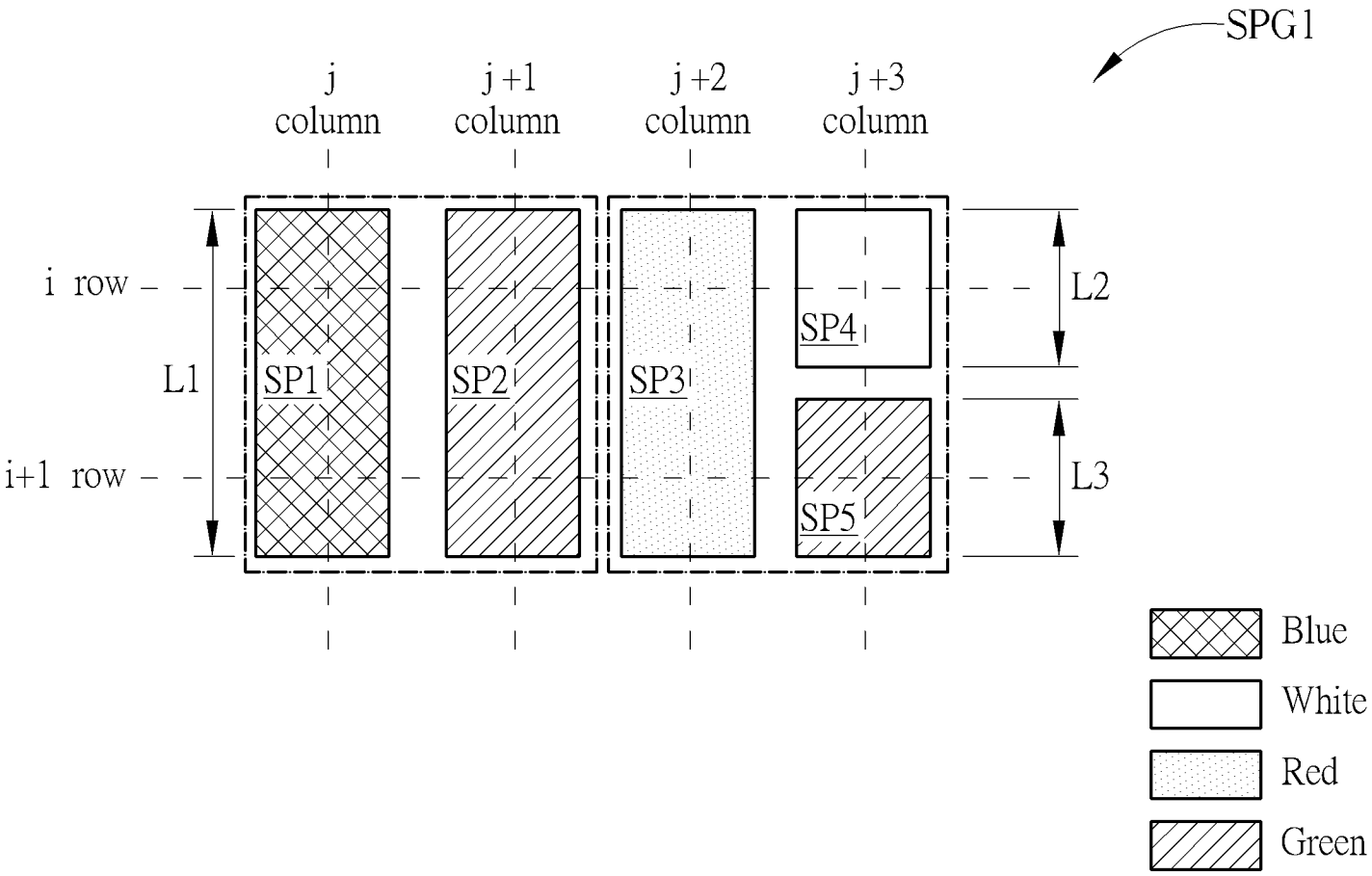
FIG. 3 is a schematic diagram of the sub-pixel group shown in FIG. 2.

Please refer to FIG. 2, which is a schematic diagram of a display device 20 according to an embodiment of the present invention. The display device 20 may be an electronic product with a liquid crystal panel, such as a television, a smart phone or a tablet, and is not limited herein. FIG. 2 only shows part of sub-pixels of the display device 20 for illustrations. Note that, FIG. 2 is utilized for illustrating the relative positions of the sub-pixels and not for limiting the ratio between length and width. As shown in FIG. 2, the display device 20 comprises a plurality of repeatedly arranged sub-pixel groups SPG1 (only one sub-pixel group SPG1 is marked in FIG. 2 for illustrations). In order to simplify the descriptions, please refer to FIG. 3 which is a schematic diagram of the sub-pixel group SPG1 shown in FIG. 2. In FIG. 3, the sub-pixel group SPG1 comprises sub-pixels SP1-SP5. The sub-pixel SP1 is configured at the j column, the i, i+1 rows; the sub-pixel SP2 is configured at the j+1 column, the i, i+1 rows; the sub-pixel SP3 is configured at the j+2 column and the i, i+1 rows; and the sub-pixels SP4 and SP5 are configured at the j+3 column and respectively configured at the i and i+1 rows. Via the abovementioned arrangement method of the sub-pixels SP1-SP5, the sub-pixel group SPG1 is corresponding to 2 pixels. That is, a number of the sub-pixels corresponding to a pixel is reduced, so as to increase the aperture ratio of display device 20 and decrease the power consumption of the display device 20.

In detail, the sub-pixels SP1-SP3 may equip with a same height L1 and the height L1 is greater than a height L2 of the sub-pixel SP4 and a height L3 of the sub-pixel SP5. In this embodiment, a sum of the heights L2 and L3 is smaller than or equal to the height L1. For example, the heights L2 and L3 may be half of the height L1. Note that, the heights L2 and L3 may be the same or different as long as the sum of the heights L2 and L3 is smaller than or equal to the height L1. On the other hand, the sub-pixels SP1-SP5 are corresponding to blue, green, red, white and green, respectively. Via adding the sub-pixel SP4 corresponding to white, the brightness of the display device 20 is increased and the power consumption of the display device 20 is reduced.

In an embodiment, the sub-pixel SP4 may be altered to be corresponding to another color (e.g. yellow). Further, the colors corresponding to the sub-pixels SP1-SP5 in the sub-pixel group SPG1 may be changed according to different applications and design concepts, and are not limited by those shown in FIG. 3. For example, the sub-pixels SP1-SP5 are corresponding to more than 4 colors. In other words, the sub-pixels SP1-SP5 in the sub-pixel group SPG1 are corresponding to at least 4 colors.

As shown in FIG. 3, the sub-pixels SP1 and SP2 are corresponding to a pixel and the sub-pixels SP3-SP5 are corresponding to another pixel. If the problem of lacking colors occurs when the sub-pixels SP1 and SP2 or the sub-pixels SP3-SP5 display the corresponded pixel, the display device 20 may borrow the colors from surrounding sub-pixels via adopting an algorithm (e.g. the sub-pixel rendering algorithm), to display the corresponded pixel completely. In the sub-pixel group SPG1, 5 sub-pixels are corresponding to 2 pixels. That is, the average number of sub-pixels required by each pixel is decreased to 2.5. If the resolution of the display device 20 keeps constant, the number of the sub-pixels utilized for realizing the display device 20 is reduced and the aperture ratio of the display device 20 is increased.

Figure 4:
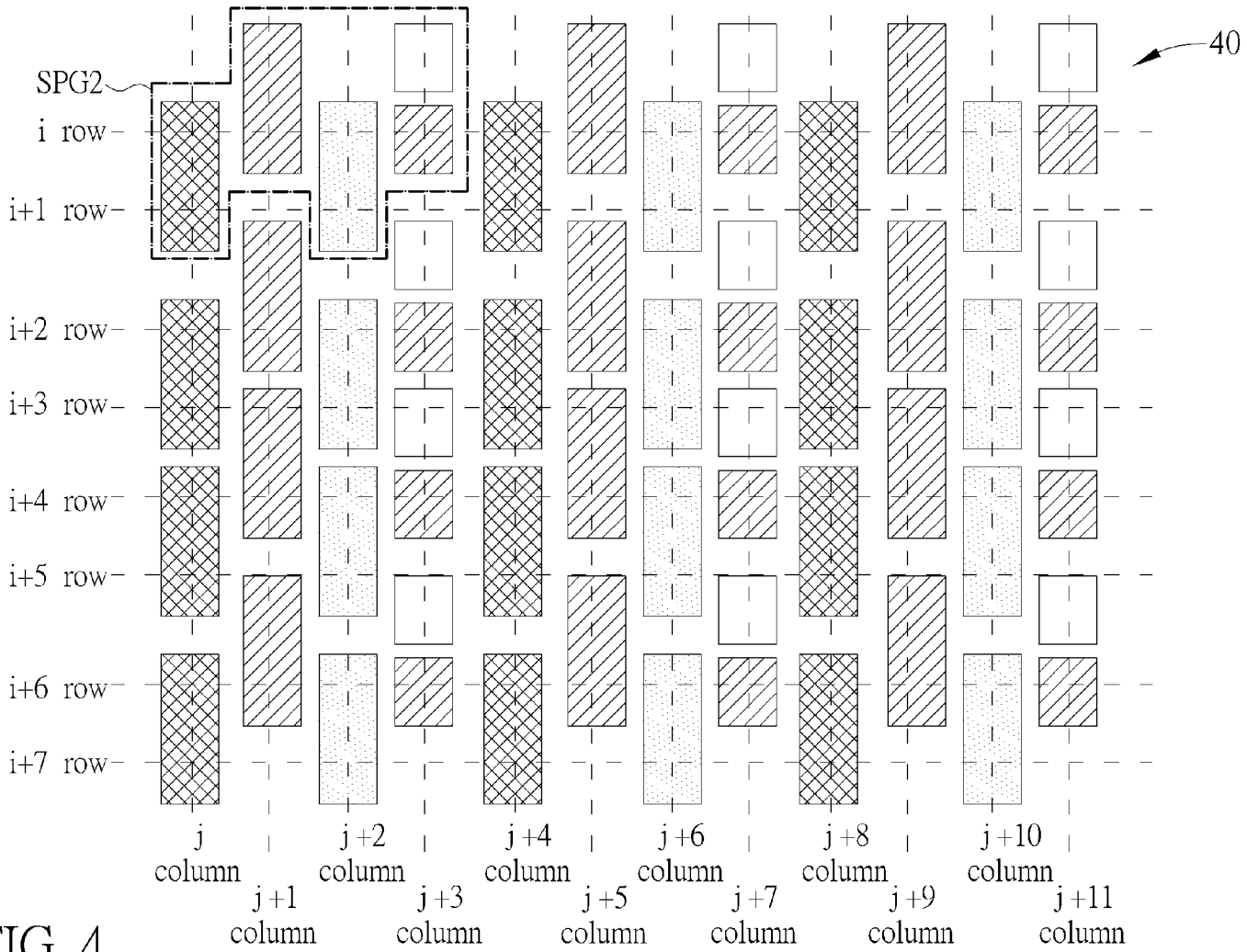
FIG. 4 is a schematic diagram of a display device according to an embodiment of the present invention.
Figure 5:
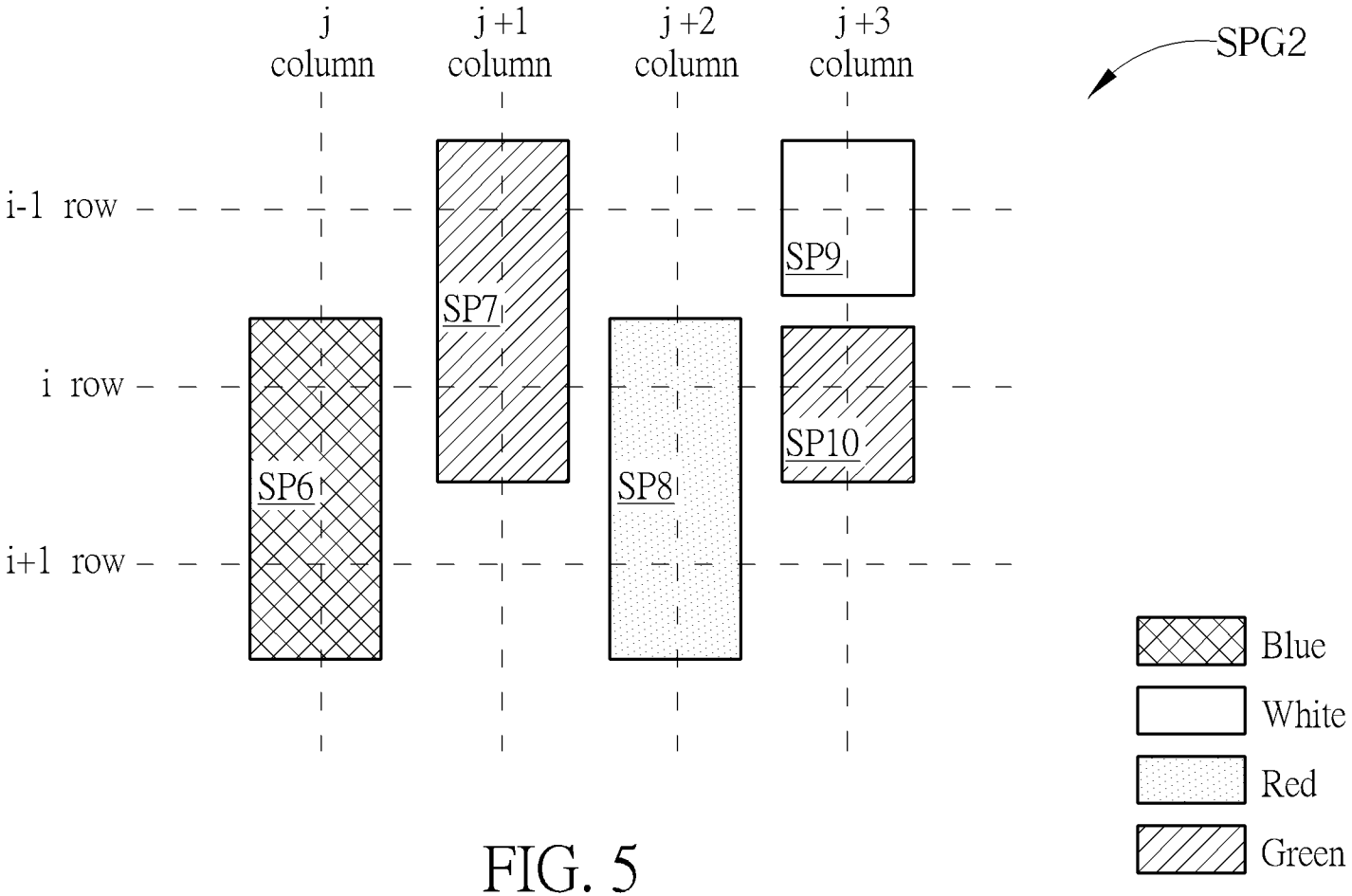
FIG. 5 is a schematic diagram of the sub-pixel group shown in FIG. 4.

In an embodiment, a vertical displacement may exist between the sub-pixels of the display device 20 shown in FIG. 2. Please refer to FIG. 4, which is a schematic diagram of a display device 40 according to an embodiment of the present invention. The display device 40 may be an electronic product with a liquid crystal panel, such as a television, a smart phone or a tablet, and is not limited herein. FIG. 4 only shows part of sub-pixels of the display device 40 for illustrations. Note that, FIG. 4 is utilized for illustrating the relative positions of the sub-pixels and not for limiting the ratio between length and width. As shown in FIG. 4, the display device 40 comprises a plurality of repeatedly arranged sub-pixel groups SPG2 (only one sub-pixel group SPG2 is marked in FIG. 4 for illustrations). In order to simplify the descriptions, please refer to FIG. 5 which is a schematic diagram of the sub-pixel group SPG2 shown in FIG. 4. In FIG. 5, the sub-pixel group SPG2 comprises sub-pixels SP6-SP10. The sub-pixel SP6 is configured at the j column and the i, i+1 rows. Different from the sub-pixel group SPG1 shown in FIG. 3, a vertical displacement exists between the sub-pixel SP7 and the sub-pixel SP6 and the sub-pixel SP7 is changed to configured at the j+1 column and the i−1, i rows. Similarly, the sub-pixel SP8 is configured at the j+2 column and the i, i+1 rows and the sub-pixels SP9 and SP10 are shifted upwards and configured at the i−1, i rows. Via the abovementioned arrangement method of the sub-pixels SP6-SP10, the sub-pixel group SPG2 is corresponding to two pixels and the aperture ratio of the display device 40 is accordingly increased. The colors and the length-width relationships between the sub-pixels SP6-SP10 of the sub-pixel group SPG2 can be referred to those of the sub-pixels SP1-SP5 of the sub-pixel group SPG1, and are not narrated herein for brevity.

Figure 6:
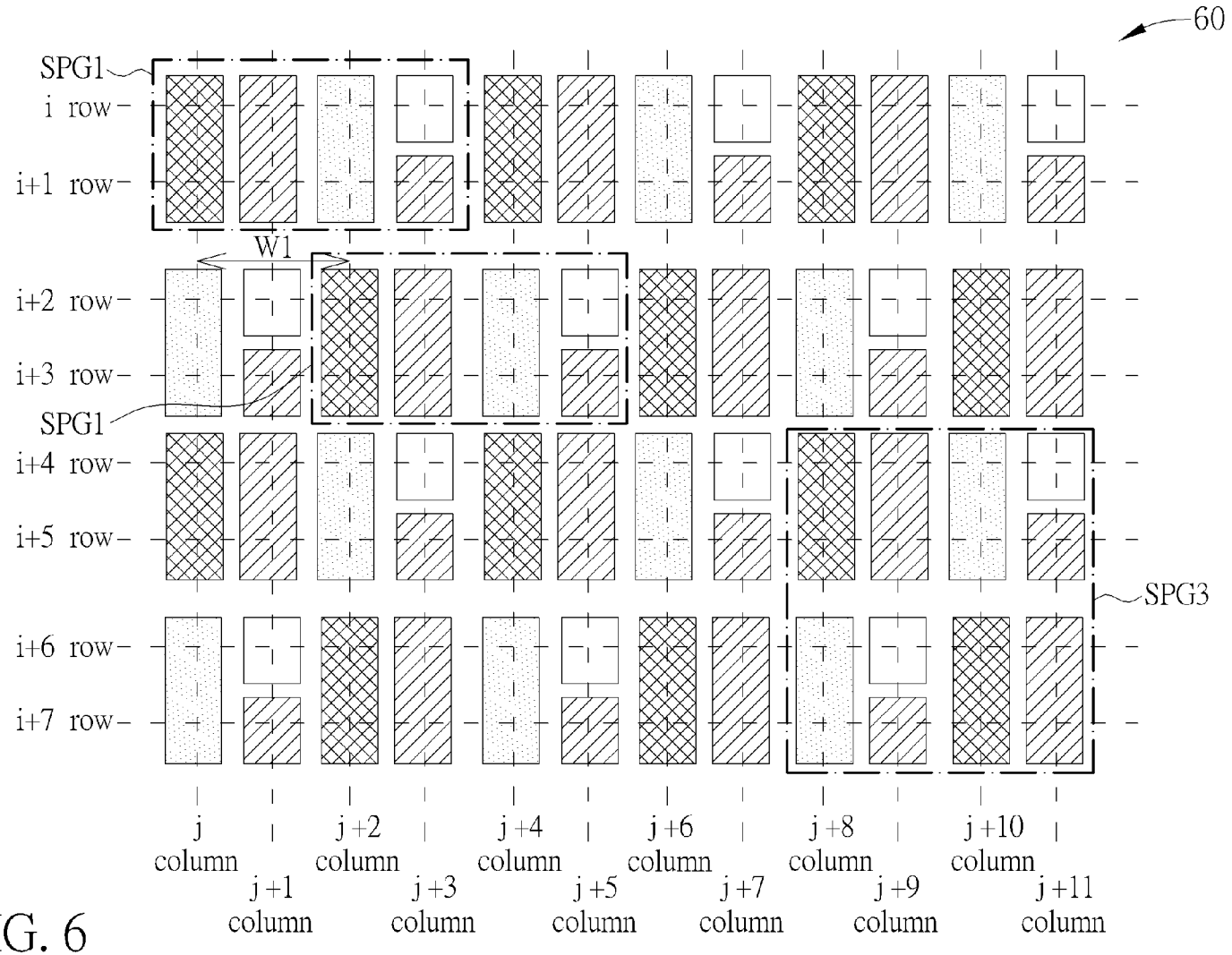
FIG. 6 is a schematic diagram of a display device according to an embodiment of the present invention.

In an embodiment, a horizontal displacement may exist between the sub-pixel groups SPG1 located of the adjacent rows in the display device 20 shown in FIG. 2. Please refer to FIG. 6, which is a schematic diagram of a display device 60 according to an embodiment of the present invention. The display device 60 is similar to the display device 20 shown in FIG. 2, thus the components with the same functions use the same symbols. Different from the display device 20, a horizontal displacement W1 exists between the sub-pixel groups SPG1 configured at the adjacent rows (e.g. the sub-pixel groups SPG1 located at the i, i+1 rows and those located at the i+2, i+3 rows). In this embodiment, the horizontal displacement W1 is half of the width of the sub-pixel group SPG1. As a result, the display device 60 with different sub-pixel arrangement can be realized by the sub-pixel group SPG1. In addition, the sub-pixel group SPG3 shown in FIG. 6 also can be regarded as the repeating sub-pixel group in this embodiment. In other words, the display device 60 shown in FIG. 6 can be acquired by repeatedly arranging the sub-pixel group SPG3.

Figure 7:
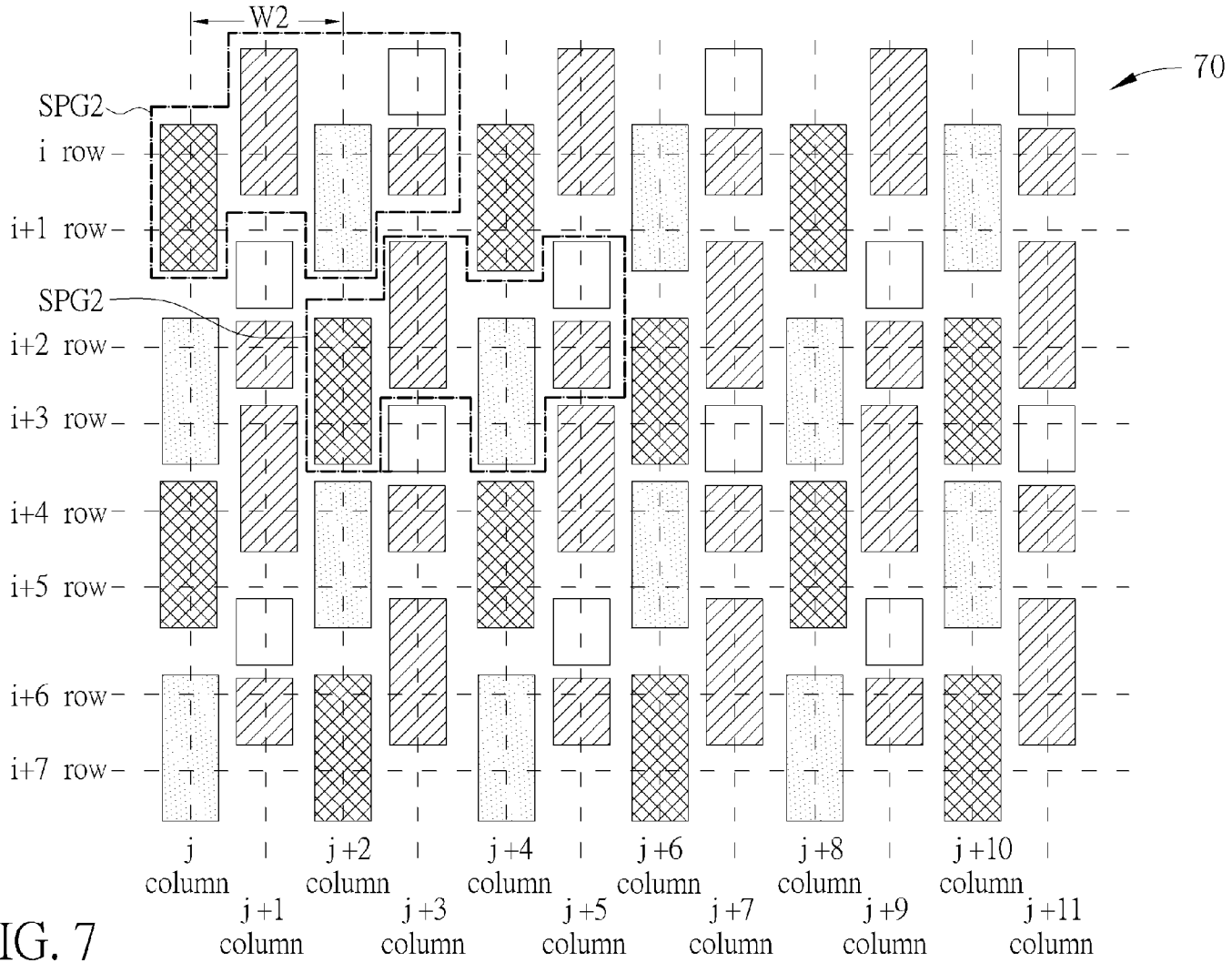
FIG. 7 is a schematic diagram of a display device according to an embodiment of the present invention.

In an embodiment, a horizontal displacement may exist between the sub-pixel groups SPG1 located at adjacent rows and a vertical displacement may exist between sub-pixels SP1-SP5 of each sub-pixel group SPG1 in the display device 20 shown in FIG. 2. Please refer to FIG. 7, which is a schematic diagram of a display device 70 according to an embodiment of the present invention. As shown in FIG. 7, the display device 70 is realized by the sub-pixel group SPG2 shown in FIG. 5. In addition, a horizontal displacement W2 exist between the sub-pixel groups SPG2 located at adjacent rows (e.g. the sub-pixel groups SPG1 located at the i, i+1 rows and those located at the i+1–i+3 rows). In this embodiment, the horizontal displacement W2 is half of the width of the sub-pixel group SPG2. As can be seen from FIG. 7, the sub-pixel arrangement of the display device 70 is different from that of the display device 20.

Figure 8:
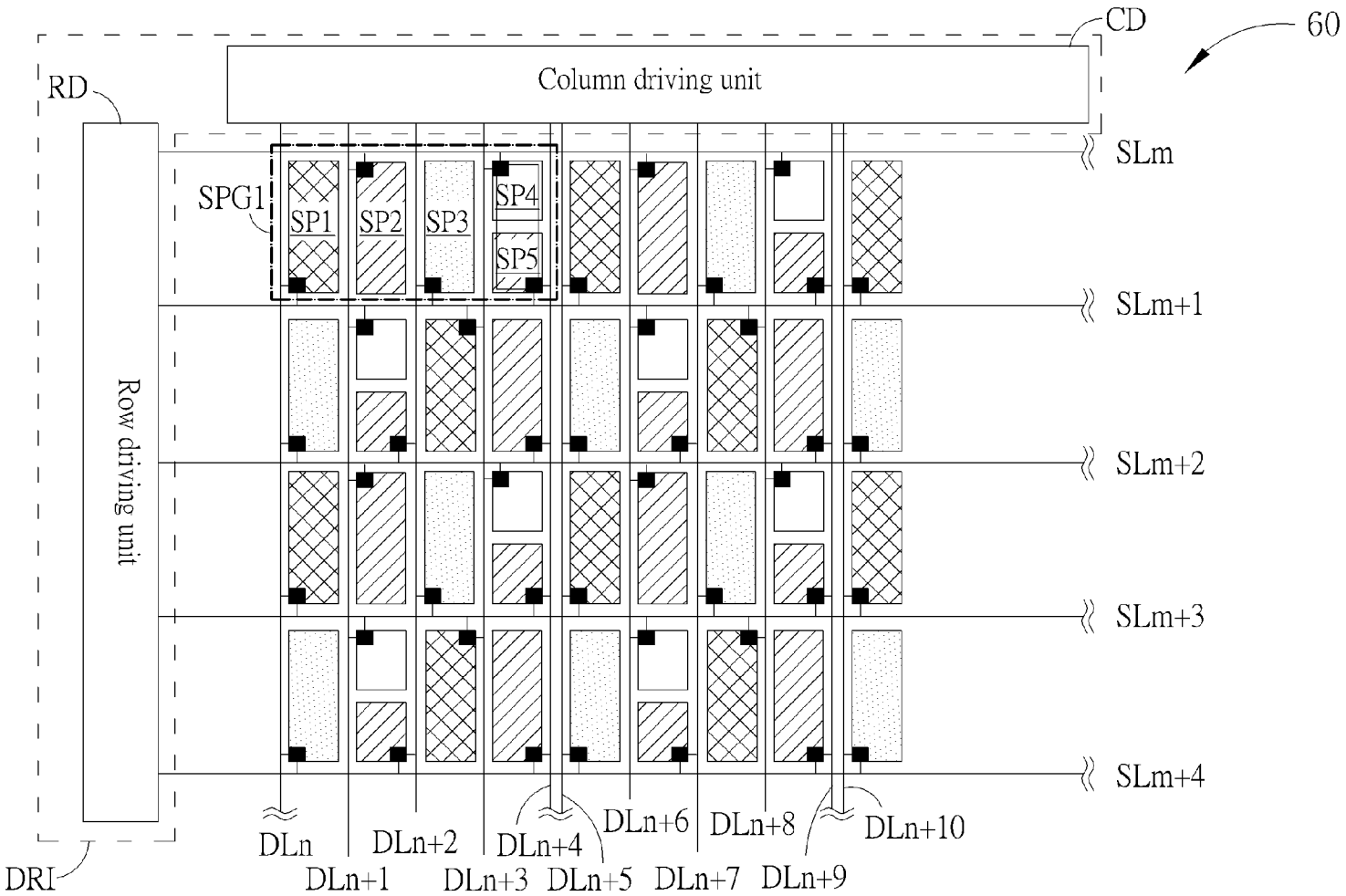
FIG. 8 is a schematic diagram of circuit layout of the display device shown in FIG. 6.

The driving module (e.g. a driving integrated chip (IC)) of the display device may need to be appropriately modified according to the sub-pixel arrangement of the above embodiments. Please jointly refer to FIG. 6 and FIG. 8, wherein FIG. 8 is a schematic diagram of a circuitry layout of the display device 60 shown in FIG. 6. As shown in FIG. 8, the display device 60 comprises a driving module DRI and a plurality of sub-pixel groups SPG1. The driving module DRI comprises a column driving unit CD and a row driving unit RD, which are utilized for driving data lines DL1-DLx and scan lines SLm-SLy, respectively. Note that, FIG. 8 only shows the data line DLn-DLn+10, the scan lines SLm-SLm+4 and part of the plurality of sub-pixel groups SPG1 for illustrations. In the sub-pixel group SPG1 at the left-top corner, the sub-pixel SP1 is coupled to the data line DLn and the scan line SLm+1; the sub-pixel SP2 is coupled to the data line DLn+1 and the scan line SLm; the sub-pixel SP3 is coupled to the data line DLn+2 and the scan line SLm+1; the sub-pixel SP4 is coupled to the data line DLn+3 and the scan line SLm; and the sub-pixel SP5 is coupled to the data line DLn+4 and the scan line SLm+1. In brief, the sub-pixels SP1, SP3 and SP5 of the sub-pixel group SPG1 are coupled to the same scan line (e.g the scan line SLm+1), the sub-pixels SP2 and SP4 of the sub-pixel group SPG1 are coupled to an adjacent scan line (e.g. the scan line SLm), and the sub-pixels SP1-SP5 are respectively coupled to the closest data lines. As a result, the layout of the display device 60 realized by repeatedly arranging the sub-pixel group SPG1 is optimized.

Figure 9:
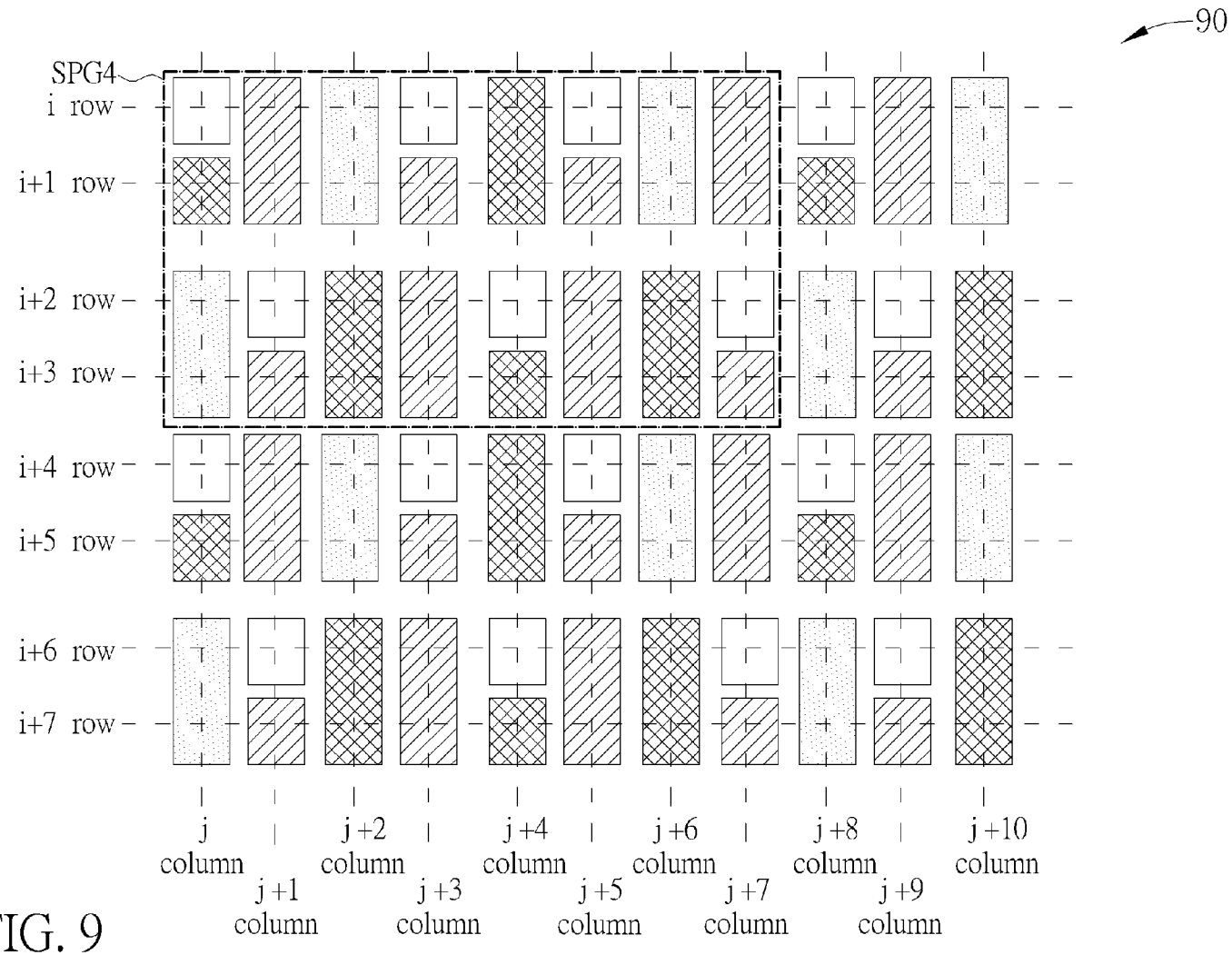
FIG. 9 is a schematic diagram of a display device according to an embodiment of the present invention.
Figure 10:
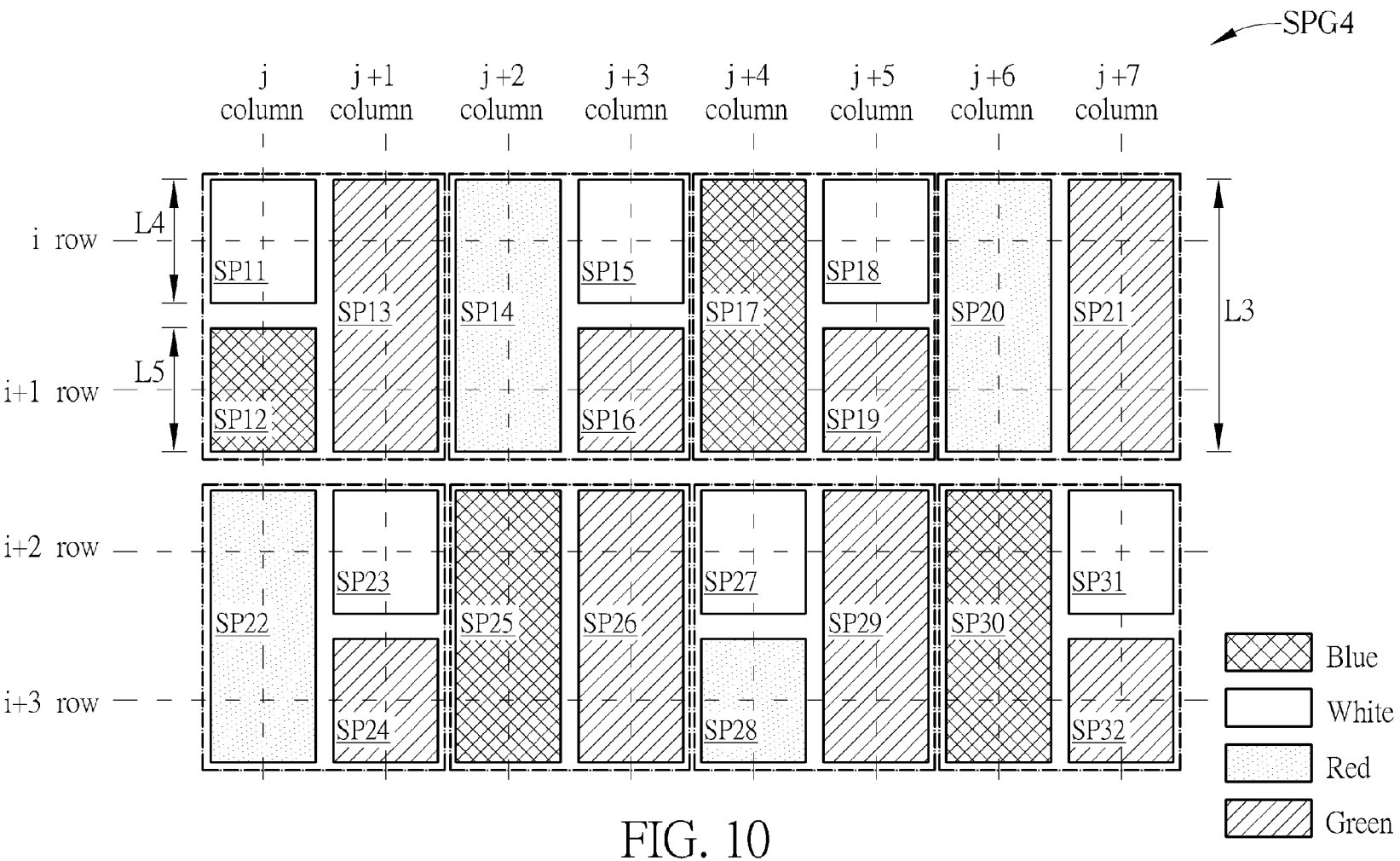
FIG. 10 is a schematic diagram of the sub-pixel group shown in FIG. 9.

According to different applications and design concepts, the number of the sub-pixels in the repeating sub-pixel group may be appropriately adjusted. Please refer to FIG. 9, which is a schematic diagram of a display device 90 according to an embodiment of the present invention. The display device 90 may be an electronic product with a liquid crystal panel, such as a television, a smart phone or a tablet. FIG. 9 only shows parts of sub-pixels of the display device 90 for illustrations. Note that, FIG. 9 is utilized for illustrating the relative positions of the sub-pixels and not for limiting the ratio between length and width. As shown in FIG. 9, the display device 90 comprises a plurality of repeating sub-pixel groups SPG4 (only one sub-pixel group SPG4 is marked in FIG. 9 for illustrations). In order to simplify the descriptions, please refer to FIG. 10 which is a schematic diagram of the sub-pixel group SPG6 shown in FIG. 9. In FIG. 10, the sub-pixel group SPG4 comprises sub-pixels SP11-SP32. The sub-pixel SP11 is located at the j column, the i row; the sub-pixel SP12 is located at the j column and the i+1 row; the sub-pixel SP13 is located at the j+1 column and the i, i+1 rows; the sub-pixel SP14 is located at the j+2 column and the i, i+1 rows; the sub-pixel SP15 is located at the j+3 column and the i row; the sub-pixel SP16 is located at the j+3 column and the i+1 row; the sub-pixel SP17 is located at the j+4 column and the i, i+1 rows; the sub-pixel SP18 is located at the j+5 column and the i row; the sub-pixel SP19 is located at the j+5 column and the i+1 row; the sub-pixel SP20 is located at the j+6 column and the i, i+1 rows; the sub-pixel SP21 is located at the j+7 column and the i, i+1 rows; the sub-pixel SP22 is located at the j column and the i+2, i+3 rows; the sub-pixel SP23 is located at the j+1 column and the i+2 row; the sub-pixel SP24 is located at the j+1 column and the i+3 row; the sub-pixel SP25 is located at the j+2 column and the i+2, i+3 rows; the sub-pixel SP26 is located at the j+3 column and the i+2, i+3 rows; the sub-pixel SP27 is located at the j+4 column and the i+2 row; the sub-pixel SP28 is located at the j+4 column and the i+3 row; the sub-pixel SP29 is located at the j+5 column and the i+2, i+3 rows; the sub-pixel SP30 is located at the j+6 column and the i+2, i+3 rows; the sub-pixel SP31 is located at the j+7 column and the i+2 row; and the sub-pixel SP32 is located at the j+7 column and the i+3 row. According to the sub-pixel arrangement shown in FIG. 10, the sub-pixel group SPG4 utilizes 22 sub-pixels to form 8 pixels. In other words, a number of the sub-pixels form a pixel is reduced when the resolution of the display device 90 keeps constant. The aperture ratio of display device 90 is increased and the power consumption of the display device 90 is decreased, therefore.

In details, the sub-pixels SP13, SP14, SP17, SP20, SP21, SP22, SP25, SP26, SP29 and SP30 equip with a same height L3 and the height L3 is greater than or equal to a sum of a height L4 of the sub-pixel SP11 and a height L5 of the sub-pixel SP12 (i.e. L3≥L4+FL5). In this embodiment, the heights L4 and L5 are half of the height L3. As long as the sum of the heights L4 and L5 is smaller than or equal to the height L3, the heights L4 and L5 maybe the same or different. Similar to the sub-pixels SP11 and SP12, a sum of the heights of the sub-pixels SP15 and SP16, a sum of the heights of the sub-pixels SP18 and SP19, a sum of the heights of the sub-pixels SP23 and SP24, a sum of the heights of the sub-pixels SP27 and SP28, and a sum of the heights of the sub-pixels SP31 and SP32 are also smaller than or equal to the height L3.

As shown in FIG. 10, the adjacent pixels in the sub-pixel group SPG4 are corresponding to different colors. In this embodiment, the sub-pixels SP11, SP15, SP18, SP23, SP27, and SP31 are corresponding to white; the sub-pixels SP12, SP17, SP25 and SP30 are corresponding to blue; the sub-pixels SP13, SP16, SP19, SP21, SP24, SP26, SP29 and SP32 are corresponding to green; and the sub-pixels SP14, SP20, SP22 and SP28 are corresponding to red. Via adding the sub-pixels SP11, SP15, SP18, SP23, SP27 and SP31 corresponding to white, the brightness of the display device 90 is increased and the power consumption of the display device 90 is decreased.

According to different applications and design concepts, the colors corresponding to the sub-pixels SP11-SP32 in the sub-pixel group SPG4 may be changed. For example, the sub-pixels SP11, SP15, SP18, SP23, SP27 and SP31 may be altered to be corresponding to yellow. In another embodiment, the sub-pixels SP11-SP32 are corresponding to more than 4 colors. That is, the sub-pixels SP11-SP32 in the sub-pixel group SPG4 are corresponding to at least 4 colors.

As to the relationships between the pixels and the sub-pixels SP11-SP32 in the sub-pixel group SPG4, please refer to the followings. As shown in FIG. 10, the sub-pixels SP11-SP13, the sub-pixels SP14-SP16, the sub-pixels SP17-SP19, the sub-pixels SP20, SP21, the sub-pixels SP22-SP24, the sub-pixels SP25, SP26, the sub-pixels SP27-SP29 and the sub-pixels SP30-SP32 are respectively corresponding to different pixels. If the problem of lacking colors occurs when the sub-pixel group SPG4 displays the corresponded pixels, the display device 90 may borrow the colors from surrounding sub-pixels via adopting an algorithm (e.g. sub-pixel rendering algorithm), for displaying the corresponded pixel completely. In such a condition, 22 sub-pixels are corresponding to 8 pixels in the sub-pixel group SPG4. In other words, the number of sub-pixels required to form one pixel is decreased to 2.5. If the resolution of the display device 90 keeps constant, the number of the sub-pixels utilized for realizing the display device 90 is reduced and the aperture ratio of the display device 90 is accordingly increased.

Figure 11:
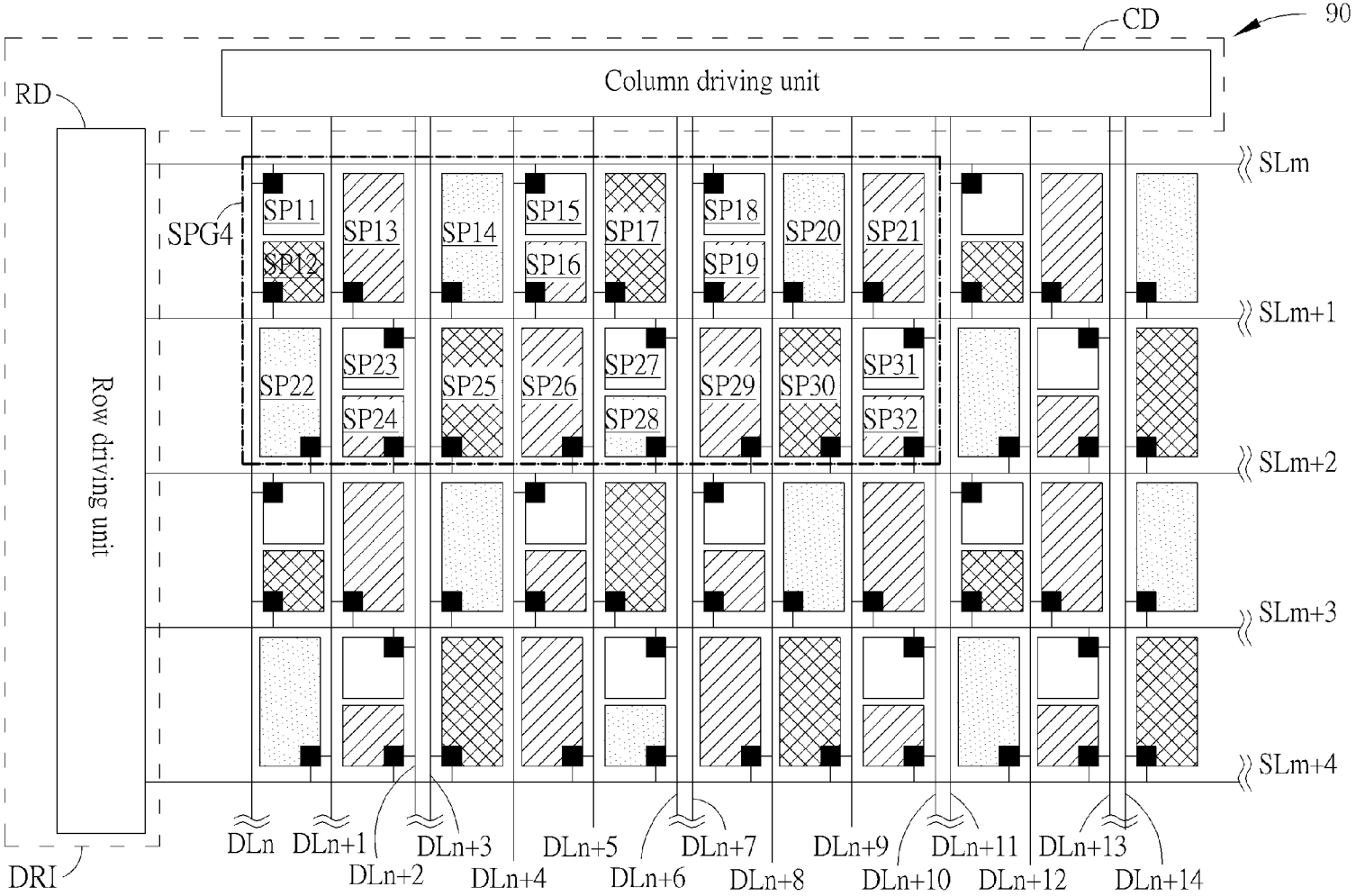
FIG. 11 is a schematic diagram of circuit layout of the display device shown in FIG. 9.

The driving module (e.g. a driving integrated chip (IC)) of the display device 90 may need to be appropriately modified according to the sub-pixel arrangement of the above embodiment. Please jointly refer to FIG. 9 and FIG. 11, wherein FIG. 11 is a schematic diagram of a circuitry layout of the display device 90 shown in FIG. 9. As shown in FIG. 11, the display device 90 comprises a driving module DRI and a plurality of sub-pixel groups SPG4. The driving module DRI comprises a column driving unit CD and a row driving unit RD, which are utilized for driving data lines DL1-DLx and scan lines SLm-SLy, respectively. Note that, FIG. 11 only shows the data lines DLn-DLn+14, the scan lines SLm-SLm+4 and part of the plurality of sub-pixel groups SPG4 for illustrations. The coupling relationships between scan lines SLm-SLm+2 and each of the sub-pixels SP11-SP32 in the sub-pixel group SPG4 at the left-top corner are described as the followings. The sub-pixels SP11, SP15 and SP18 are coupled to the scan line SLm; the sub-pixels SP12-Sp14, SP16, SP17, SP19-SP21, SP23, SP27 and SP31 are coupled to the scan line SLm 1; and the sub-pixels SP22, SP24-SP26, SP28-SP30 and SP32 are coupled to the scan line SLm+2. The coupling relationships between data lines DLn-DLn+10 and each of the sub-pixels SP11-SP32 in the sub-pixel group SPG4 at the left-top corner are described as the followings. The sub-pixel SP11 and SP12 are coupled to the data line DLn; the sub-pixels SP13 and SP22 are coupled to the data line DLn+1; the sub-pixels SP23 and SP24 are coupled to the data line DLn+2; the sub-pixels SP14 and SP25 are coupled to the data line DLn+3; the sub-pixels SP15 and SP16 are coupled to the data line DLn+4; the sub-pixels SP17 and SP26 are coupled to the data line DLn+5; the sub-pixels SP27 and SP28 are coupled to the data line DLn+6; the sub-pixels SP18 and SP19 are coupled to the data line DLn+7; the sub-pixels SP20 and SP29 are coupled to the data line DLn+8; the sub-pixels SP21 and SP30 are coupled to the data line DLn+9; and the sub-pixels SP31 and SP32 are coupled to the data line DLn+10. The coupling relationships between other sub-pixels and the data lines DLn-DLn+14 or the scan lines SLm-SLm+4 can be referred to the above. According to the above example, the layout of the display device 90 realized by repeatedly arranging the sub-pixel group SPG4 is optimized.

Figure 12A:
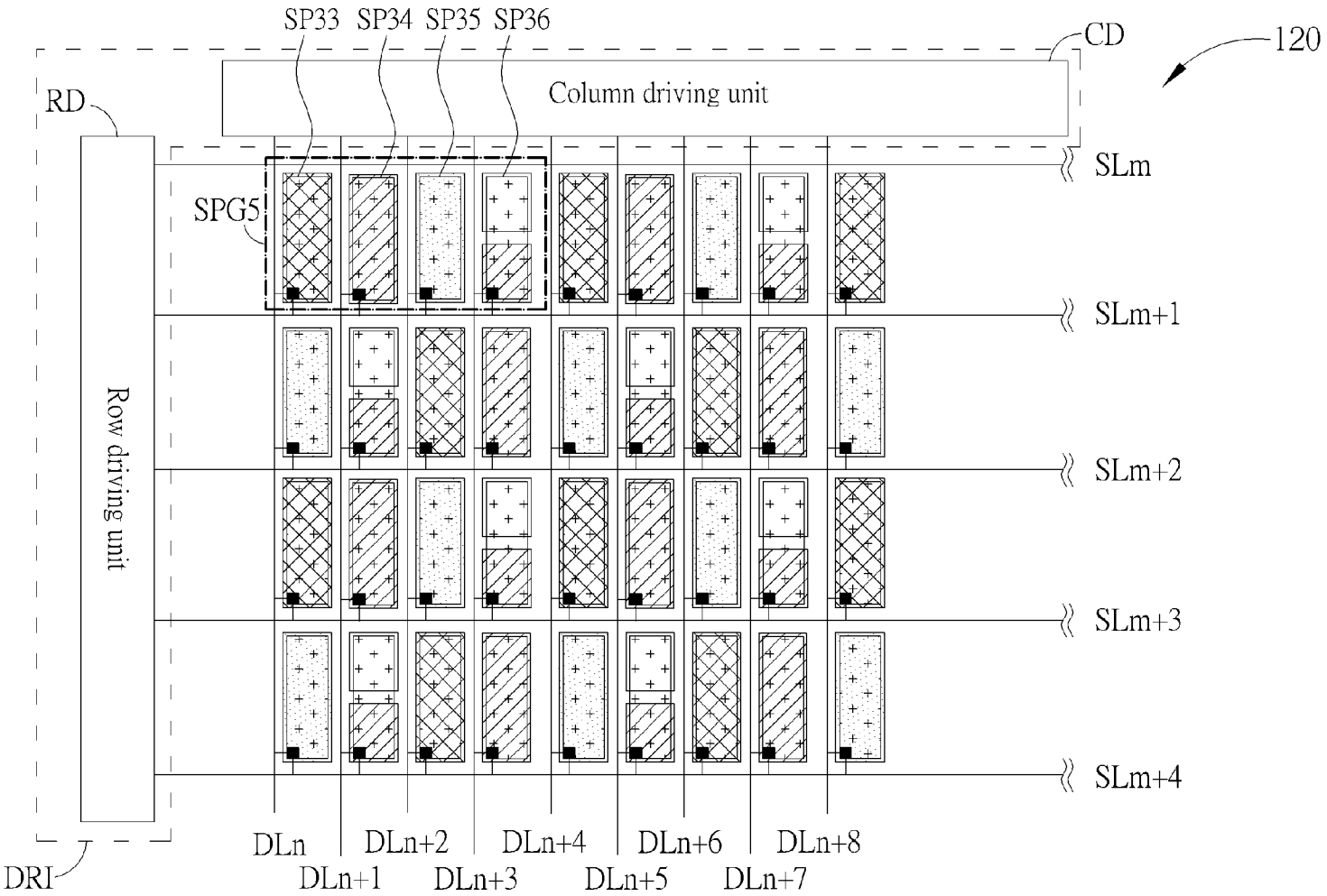
FIG. 12A is a schematic diagram of circuit layout of the display device according to an embodiment of the present invention.

The above embodiments utilize different sub-pixel arrangements to decrease the number of the sub-pixels corresponding to each pixel. The aperture ration, the brightness of the display device are increased, the power consumption and the layout area of the display device are decreased, therefore. According to different applications and design concepts, those with ordinary skill in the art may observe appropriate alternations and modifications. Please refer to FIG. 12A, which is a schematic diagram of a display device 120 according to an embodiment of the present invention. As shown in FIG. 12A, the display device 120 comprises a plurality of repeatedly arranged sub-pixel groups SPG5 (only one sub-pixel group SPG5 is marked in FIG. 12A for illustration) and a driving module DRI. The driving module DRI comprises a column driving unit CD and a row driving unit RD, which are utilized for driving data lines DL1-DLx and scan lines SLm-SLy, respectively. Note that, FIG. 12A only shows the data lines DLn-DLn+8, scan lines SLm-SLm+4 and parts of the plurality of sub-pixel groups SPG5 for illustrations. The sub-pixel group SPG5 is similar to the sub-pixel group SPG1 shown in FIG. 3. Note that, the sub-pixel group SPG5 utilizes a sub-pixel (e.g. a sub-pixel SP36) and two color filters to form the sub-pixels SP4 and SP5 in the sub-pixel group SPG1. That is, the designer may implement the display device 120 by modifying the arrangement of the color filters instead of changing the configuration of the pixel array. In such a condition, the number of the sub-pixels utilized for realizing the display device 120 is reduced, such that the aperture ratio of the display device 120 is accordingly increased and the power consumption and the layout area of the display device 120 is decreased.

Figure 12B:
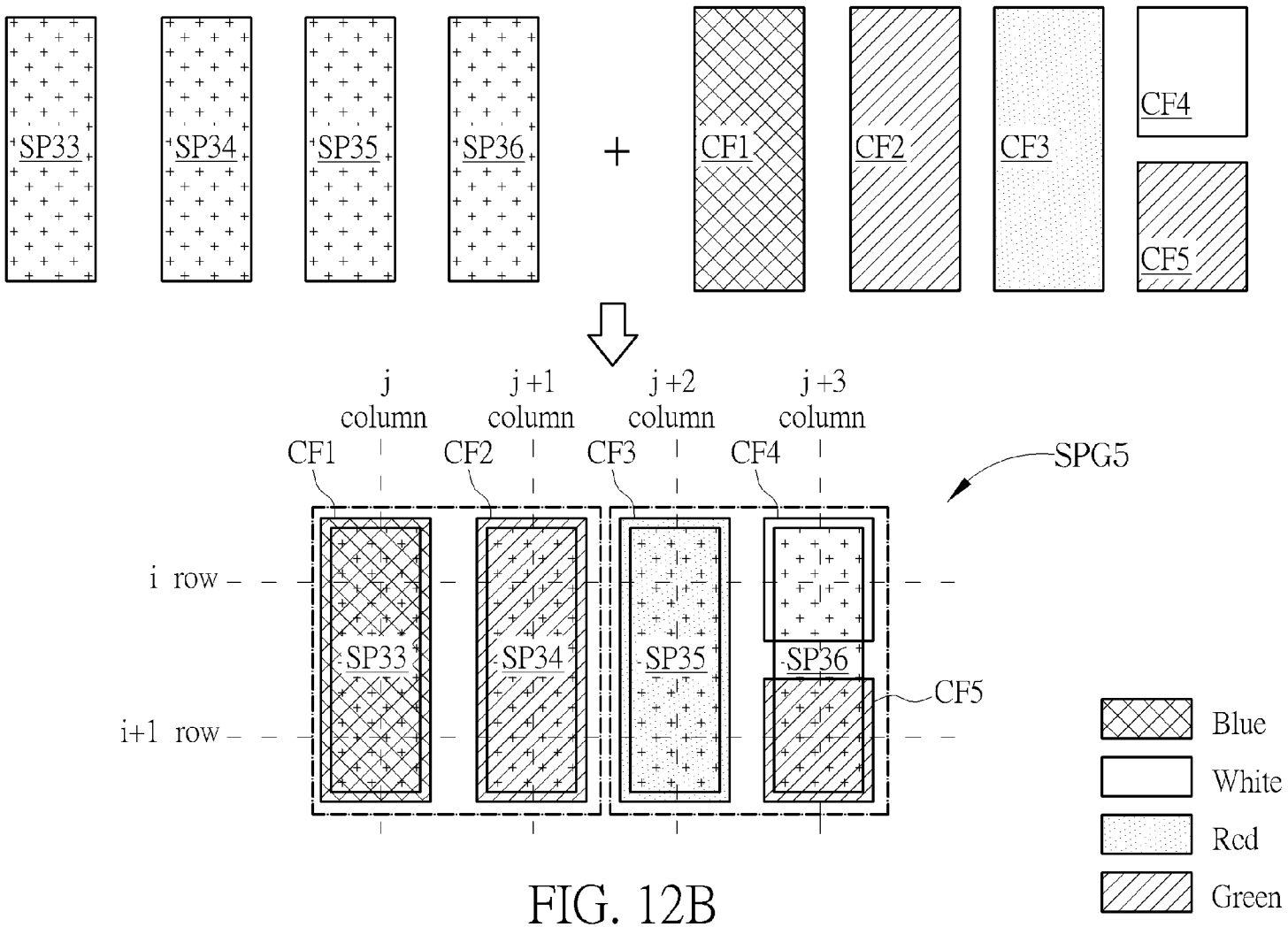
FIG. 12B is a schematic diagram of the sub-pixel group shown in FIG. 12A.

Please refer to FIG. 12B, which is a schematic diagram of the sub-pixel group SPG5 shown in FIG. 12A. As shown in FIG. 12B, the sub-pixel group SPG5 is consisted of sub-pixels SP33-SP36 uncovered by the color filters and the color filters CF1-CF5, wherein the color filters CF1-CF3 and CF5 are corresponding to red, green, blue and green, and the color filter CF4 is corresponding to white, which equips with the brightness higher than those of red, blue and green. Via combining the sub-pixels SP33-SP36 uncovered by the color filters and the color filters CF1-CF5, the sub-pixel group SPG5, which is similar to the sub-pixel group SPG1 shown in FIG. 3, is therefore acquired. In comparison with the sub-pixel group SPG1 shown in FIG. 3, the sub-pixels SP4 and SP5 are consisted of the sub-pixel SP36 and the color filters CF4 and CF5 in FIG. 12B. Under such a condition, the difference between the color temperature of white and each of those of other colors displayed by the sub-pixel group SPG5 is reduced.

In addition, since the arrangement of the pixel array in the display device 120 remains the same, the coupling relationships between each sub-pixel and the data lines DL1-DLx scan lines SL1-SLy do not need to change. The number of the data lines DL1-DLx is therefore reduced. For example, the sub-pixels SP33-SP36 are coupled to the scan line SLm and coupled to the data lines DLn-DLn+3, respectively, in the sub-pixel group SPG5 located at the top-left corner. In other words, the coupling relationships between the sub-pixels and the driving module DRI in the display device 120 are not required to be re-designed, so as to reduce the design complexity and the difficulty of manufacturing.

According to different applications and design concepts, the colors of the color filters CF1-CF5 in the sub-pixel group SPG5 may be accordingly changed. For example, the color of the color filter CF4 may change to a color with the brightness higher than red, green and blue (e.g. yellow). In addition, the color of the color filter CF5 may be altered to a color different from those of the color filters CF1-CF4. The alternations of the color arrangement of the color filters CF1-CF5 in sub-pixel group SPG5 can be referred to those of the color arrangement of the sub-pixels SP1-SP5 in the sub-pixel group SPG1, and are not narrated herein for brevity.

To sum up, the above embodiments reduce the number of sub-pixels for realizing the display device via altering the sub-pixel arrangement in the display device, so as to increase the aperture ratio and to decrease the power consumption and the layout area of the display device. Moreover, the brightness of the display device is increased and the power consumption is further decreased via adding the sub-pixels corresponding to white.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display device comprising a plurality of sub-pixel groups, wherein each of the sub-pixel groups comprises:

a first sub-pixel, located at a first column;

a second sub-pixel, located at a second column adjacent to the first column;

a third sub-pixel, located at a third column adjacent to the second column;

a fourth sub-pixel, located at a fourth column adjacent to the third column; and a fifth sub-pixel, located at the fourth column;

wherein the row of the second sub-pixel overlaps the row of the first sub-pixel;

wherein the row of the third sub-pixel overlaps the row of the first sub-pixel;

wherein the row of at least one of the fourth sub-pixel and the fifth sub-pixel overlaps the row of the first sub-pixel;

wherein a sum of the heights of the fourth sub-pixel and the fifth sub-pixel is smaller than or equal to the height of the first sub-pixel.

2. The display device of claim 1, wherein the first sub-pixel, the second sub-pixel, the third sub-pixel, the fourth sub-pixel and the fifth sub-pixel are corresponding to at least four colors.

3. The display device of claim 1, wherein a horizontal displacement exists between the sub-pixel groups located at adjacent rows.

4. The display device of claim 1, wherein the first sub-pixel and the second sub-pixel are corresponding to a first pixel and the third sub-pixel, the fourth sub-pixel and the fifth sub-pixel are corresponding to a second pixel.

5. The display device of claim 1, wherein the first sub-pixel is realized by the sub-pixel uncovered by the color filer and a first color filter, the second sub-pixel is realized by the sub-pixel uncovered by the color filer and a second color filter, the third sub-pixel is realized by the sub-pixel uncovered by the color filer and a third color filter, the fourth sub-pixel and the fifth sub-pixel are realized by the same sub-pixel uncovered by the color filer, a fourth color filter and a fifth color filter.

6. A driving module for a display device comprising a plurality of sub-pixel groups, wherein each of the sub-pixel groups comprises a first sub-pixel, located at a first column; a second sub-pixel, located at a second column adjacent to the first column; a third sub-pixel, located at a third column adjacent to the second column; a fourth sub-pixel, located at a fourth column adjacent to the third column; and a fifth sub-pixel, locate at the fourth column;

wherein the row of the second sub-pixel overlaps the row of the first sub-pixel;

wherein the row of the third sub-pixel overlaps the row of the first sub-pixel;

wherein the row of at least one of the fourth sub-pixel and the fifth sub-pixel overlaps the row of the first sub-pixel;

wherein a sum of the heights of the fourth sub-pixel and the fifth sub-pixel is smaller than or equal to the height of the first sub-pixel.

7. The driving module of claim 6, comprising:

a row driving unit, for driving a plurality of scan lines, wherein the first sub-pixel, the third sub-pixel and the fifth sub-pixel of a first sub-pixel group are coupled to a first scan line of the plurality scan lines and the second sub-pixel and the fourth sub-pixel of the first sub-pixel group are coupled to a second scan line adjacent to the first scan line; and a column driving unit, for driving a plurality of data lines, wherein the first sub-pixel of the first sub-pixel group is coupled to a first data line of the plurality of data lines, the second sub-pixel of the first sub-pixel group is coupled to a second data line adjacent to the first data line, the third sub-pixel of the first sub-pixel group is coupled to a third data line adjacent to the second data line, the fourth sub-pixel of the first sub-pixel group is coupled to a fourth data line adjacent to the third data line and the fifth sub-pixel of the first sub-pixel group is coupled to a fifth data line adjacent to the fourth data line.

8. The driving module of claim 6, wherein the first sub-pixel, the second sub-pixel, the third sub-pixel, the fourth sub-pixel and the fifth sub-pixel are corresponding to at least four colors.

9. The driving module of claim 6, wherein a horizontal displacement exists between the sub-pixel groups located at adjacent rows.

10. The driving module of claim 6, wherein the first sub-pixel and the second sub-pixel are corresponding to a first pixel and the third sub-pixel, the fourth sub-pixel and the fifth sub-pixel are corresponding to a second pixel.

11. A display device comprising a plurality of sub-pixel groups, wherein each of the sub-pixel groups comprises:

a first sub-pixel, located at a first column;

a second sub-pixel, located at the first column;

a third sub-pixel, located at a second column adjacent to the first column;

a fourth sub-pixel, located at a third column adjacent to the second column; and a fifth sub-pixel, located at the fourth column adjacent to the third column;

a sixth sub-pixel, located at the fourth column;

a seventh sub-pixel, located at a fifth column adjacent to the fourth column;

an eighth sub-pixel, located at a sixth column adjacent to the fifth column;

a ninth sub-pixel, located at the sixth column;

a tenth sub-pixel, located at a seventh column adjacent to the sixth column;

an eleventh sub-pixel, located at an eighth column adjacent to the seventh column;

a twelfth sub-pixel, located at the first column;

a thirteenth sub-pixel, located at the second column;

a fourteenth sub-pixel, located at the second column;

a fifteenth sub-pixel, located at the third column;

a sixteenth sub-pixel, located at the fourth column;

a seventeenth sub-pixel, located at the fifth column;

an eighteenth sub-pixel, located at the fifth column;

a nineteenth sub-pixel, located at the sixth column;

a twentieth sub-pixel, located at the seventh column;

a twenty-first sub-pixel, located at the eighth column;

a twenty-second sub-pixel, located at the eighth column;

wherein the rows of the first sub-pixels, the second sub-pixel, the third sub-pixel, the fourth sub-pixel, the fifth sub-pixel, the sixth sub-pixel, the seventh sub-pixel, the eighth sub-pixel, the ninth sub-pixel, the tenth sub-pixel and the eleventh sub-pixel overlap to each other;

wherein the rows of the twelfth sub-pixels, the thirteenth sub-pixel, the fourteenth sub-pixel, the fifteenth sub-pixel, the sixteenth sub-pixel, the seventeenth sub-pixel, the eighteenth sub-pixel, the nineteenth sub-pixel, the twentieth sub-pixel, the twenty-first sub-pixel and the twenty-second sub-pixel overlap to each other;

wherein the first sub-pixel and the second sub-pixel are located at adjacent rows and the second and the twelfth sub-pixel are located at adjacent rows.

12. The display device of claim 11, wherein the first sub-pixel, the second sub-pixel, the third sub-pixel, the fourth sub-pixel, the fifth sub-pixel, the sixth sub-pixel, the seventh sub-pixel, the eighth sub-pixel, the ninth sub-pixel, the tenth sub-pixel, the eleventh sub-pixel, the twelfth sub-pixels, the thirteenth sub-pixel, the fourteenth sub-pixel, the fifteenth sub-pixel, the sixteenth sub-pixel, the seventeenth sub-pixel, the eighteenth sub-pixel, the nineteenth sub-pixel, the twentieth sub-pixel, the twenty-first sub-pixel and the twenty-second sub-pixel are corresponding to at least four colors.

13. The display device of claim 11, wherein the first sub-pixels, the second sub-pixel and the third sub-pixel are corresponding to a first pixel; the fourth sub-pixel, the fifth sub-pixel, and the sixth sub-pixel are corresponding to a second pixel; the seventh sub-pixel, the eighth sub-pixel, and the ninth sub-pixel are corresponding to a third pixel; the tenth sub-pixel and the eleventh sub-pixel are corresponding to a fourth pixel; the twelfth sub-pixels, the thirteenth sub-pixel and the fourteenth sub-pixel are corresponding to a fifth pixel; the fifteenth sub-pixel and the sixteenth sub-pixel are corresponding to a sixth pixel; the seventeenth sub-pixel, the eighteenth sub-pixel and the nineteenth sub-pixel are corresponding to a seventh pixel; the twentieth sub-pixel, the twenty-first sub-pixel and the twenty-second sub-pixel are corresponding to an eighth pixel.

14. A driving module for a display device comprising a plurality of sub-pixel groups, wherein each of the sub-pixel groups comprises a first sub-pixel, located at a first column; a second sub-pixel, located at the first column; a third sub-pixel, located at a second column adjacent to the first column; a fourth sub-pixel, located at a third column adjacent to the second column; and a fifth sub-pixel, located at the fourth column adjacent to the third column; a sixth sub-pixel, located at the fourth column; a seventh sub-pixel, located at a fifth column adjacent to the fourth column; an eighth sub-pixel, located at a sixth column adjacent to the fifth column; a ninth sub-pixel, located at the sixth column; a tenth sub-pixel, located at a seventh column adjacent to the sixth column; an eleventh sub-pixel, located at an eighth column adjacent to the seventh column; a twelfth sub-pixel, located at the first column; a thirteenth sub-pixel, located at the second column; a fourteenth sub-pixel, located at the second column; a fifteenth sub-pixel, located at the third column; a sixteenth sub-pixel, located at the fourth column; a seventeenth sub-pixel, located at the fifth column; an eighteenth sub-pixel, located at the fifth column; a nineteenth sub-pixel, located at the sixth column; a twentieth sub-pixel, located at the seventh column; a twenty-first sub-pixel, located at the eighth column; a twenty-second sub-pixel, located at the eighth column;

wherein the rows of the first sub-pixels, the second sub-pixel, the third sub-pixel, the fourth sub-pixel, the fifth sub-pixel, the sixth sub-pixel, the seventh sub-pixel, the eighth sub-pixel, the ninth sub-pixel, the tenth sub-pixel and the eleventh sub-pixel overlap to each other;

wherein the rows of the twelfth sub-pixels, the thirteenth sub-pixel, the fourteenth sub-pixel, the fifteenth sub-pixel, the sixteenth sub-pixel, the seventeenth sub-pixel, the eighteenth sub-pixel, the nineteenth sub-pixel, the twentieth sub-pixel, the twenty-first sub-pixel and the twenty-second sub-pixel overlap to each other;

wherein the first sub-pixel and the second sub-pixel are located at adjacent rows and the second and the twelfth sub-pixel are located at adjacent rows.

15. The driving module of claim 14, comprising:

a row driving unit, for driving a plurality of scan lines, wherein the first sub-pixel, the fifth sub-pixel and the eighth sub-pixel of a first sub-pixel group are coupled to a first scan line of the plurality scan lines and the second sub-pixel; the second sub-pixel, the third sub-pixel, the fourth sub-pixel, the sixth sub-pixel, the seventh sub-pixel, the ninth sub-pixel, the tenth sub-pixel, the eleventh sub-pixel, the thirteenth sub-pixel, the seventeenth sub-pixel and the twenty-first sub-pixel of the first sub-pixel group are coupled to a second scan line adjacent to the first scan line; and the twelfth sub-pixel, the fourteenth sub-pixel, the fifteenth sub-pixel, the sixteenth sub-pixel, the eighteenth sub-pixel, the nineteenth sub-pixel, the twentieth sub-pixel and the twenty-second sub-pixel are coupled to a third scan line adjacent to the second scan line; and a column driving unit, for driving a plurality of data lines, wherein the first sub-pixel and the second sub-pixel of the first sub-pixel group are coupled to a first data line of the plurality of data lines; the third sub-pixel and the twelfth sub-pixel of the first sub-pixel group are coupled to a second data line adjacent to the first data line; the thirteenth sub-pixel and the fourteenth sub-pixel of the first sub-pixel group are coupled to a third data line adjacent to the second data line; the fourth sub-pixel and the fifteenth sub-pixel of the first sub-pixel group are coupled to a fourth data line adjacent to the third data line; the fifth sub-pixel and the sixth sub-pixel of the first sub-pixel group are coupled to a fifth data line adjacent to the fourth data line; the seventh sub-pixel and the sixteenth sub-pixel of the first sub-pixel group are coupled to a sixth data line adjacent to the fifth data line; the seventeenth sub-pixel and the eighteenth sub-pixel of the first sub-pixel group are coupled to a seventh data line adjacent to the sixth data line; the eighth sub-pixel and the ninth sub-pixel of the first sub-pixel group are coupled to an eighth data line adjacent to the seventh data line; the tenth sub-pixel and the nineteenth sub-pixel of the first sub-pixel group are coupled to a ninth data line adjacent to the eighth data line; the eleventh sub-pixel and the twentieth sub-pixel of the first sub-pixel group are coupled to a tenth data line adjacent to the ninth data line; and the twenty-first sub-pixel and the twenty-second sub-pixel of the first sub-pixel group are coupled to a eleventh data line adjacent to the tenth data line.

16. The driving module of claim 14, wherein the first sub-pixels, the second sub-pixel, the third sub-pixel, the fourth sub-pixel, the fifth sub-pixel, the sixth sub-pixel, the seventh sub-pixel, the eighth sub-pixel, the ninth sub-pixel, the tenth sub-pixel, the eleventh sub-pixel, the twelfth sub-pixels, the thirteenth sub-pixel, the fourteenth sub-pixel, the fifteenth sub-pixel, the sixteenth sub-pixel, the seventeenth sub-pixel, the eighteenth sub-pixel, the nineteenth sub-pixel, the twentieth sub-pixel, the twenty-first sub-pixel and the twenty-second sub-pixel are corresponding to at least four colors.

17. The driving module of claim 14, wherein the first sub-pixels, the second sub-pixel and the third sub-pixel are corresponding to a first pixel; the fourth sub-pixel, the fifth sub-pixel, and the sixth sub-pixel are corresponding to a second pixel; the seventh sub-pixel, the eighth sub-pixel, and the ninth sub-pixel are corresponding to a third pixel; the tenth sub-pixel and the eleventh sub-pixel are corresponding to a fourth pixel; the twelfth sub-pixels, the thirteenth sub-pixel and the fourteenth sub-pixel are corresponding to a fifth pixel; the fifteenth sub-pixel and the sixteenth sub-pixel are corresponding to a sixth pixel; the seventeenth sub-pixel, the eighteenth sub-pixel and the nineteenth sub-pixel are corresponding to a seventh pixel; the twentieth sub-pixel, the twenty-first sub-pixel and the twenty-second sub-pixel are corresponding to an eighth pixel.

* * * * *